US008497415B2

(12) United States Patent
Adams

(10) Patent No.: US 8,497,415 B2
(45) Date of Patent: Jul. 30, 2013

(54) PIANO HAMMER

(75) Inventor: Christopher Adams, Hamburg (DE)

(73) Assignee: Goodbuy Corporation S.A., Vaduz (LI)

( * ) Notice: Subject to any disclaimer, the term of this patent is extended or adjusted under 35 U.S.C. 154(b) by 253 days.

(21) Appl. No.: 13/120,957

(22) PCT Filed: Sep. 25, 2009

(86) PCT No.: PCT/EP2009/062445

§ 371 (c)(1),
(2), (4) Date: May 23, 2011

(87) PCT Pub. No.: WO2010/034810

PCT Pub. Date: Apr. 1, 2010

(65) Prior Publication Data

US 2011/0283860 A1 Nov. 24, 2011

(30) Foreign Application Priority Data

Sep. 26, 2008 (EP) ..... 08165302

(51) Int. Cl.
*G10C 3/18* (2006.01)

(52) U.S. Cl.
USPC ..... 84/236; 84/254

(58) Field of Classification Search
USPC ..... 84/236, 254
See application file for complete search history.

(56) References Cited

U.S. PATENT DOCUMENTS

| | | | | | |
|---|---|---|---|---|---|
| 231,630 | A | * | 8/1880 | Steinway | 84/254 |
| 295,670 | A | * | 3/1884 | Ober | 84/254 |
| 959,190 | A | * | 5/1910 | Young | 84/254 |
| 3,487,429 | A | * | 12/1969 | Johnson | 84/254 |

FOREIGN PATENT DOCUMENTS

| | | | |
|---|---|---|---|
| DE | 374594 | C | 4/1923 |
| EP | 0398519 | A | 11/1990 |
| GB | 191027823 | A | 11/1911 |

* cited by examiner

*Primary Examiner* — Jianchun Qin
(74) *Attorney, Agent, or Firm* — Hunton & Williams LLP

(57) ABSTRACT

The invention relates to a piano hammer for striking the strings of a piano, including a hammer shank and a hammer head, which is covered with a cover along at least part of its peripheral surface. The aim of the invention is to provide an improved piano hammer which can be tuned in a simple and reproducible, especially also reversible, manner. According to the invention, the cover has a varying thickness along the peripheral surface and the hammer head can be adjusted with respect to the position of its peripheral surface with which it impacts the one or more string(s) to be struck.

18 Claims, 2 Drawing Sheets

*State of the Art*

PIANO HAMMER

CROSS-REFERENCE TO RELATED APPLICATION

This application is a national stage of and claims the benefit of priority of International Patent Application No. PCT/EP2009/062445, filed on Sep. 25, 2009, which is relied on and incorporated herein by reference.

FIELD OF THE INVENTION

The invention relates to a piano hammer for striking the strings of a piano, having a hammer handle and a hammer head covered at least along part of its surface with a cover, wherein the cover is of varying density along its perimeter surface and the hammer head is adjustable with regard to the position of its perimeter surface with which the cover impacts one or more strings to be struck.

BACKGROUND OF THE INVENTION

Pianos, also called pianofortes, within the meaning of the invention, comprise the whole of those stringed instruments in which clamped strings are struck by means of a keyboard (fingerboard) via so-called hammers and are thereby caused to vibrate and to emit sounds. In this context, pianos are divided in particular into two groups, on the one hand, the so-called pianino in which the strings are clamped in and run vertically, on the other hand the grand pianos in which the strings are arranged in a horizontal alignment.

As mentioned before, in the case of such pianos, the strings typically clamped in a frame are struck by a so-called piano hammer that, due to a keystroke on the keyboard, hits the string or, respectively, the several strings (in the case of high tones, frequently two or more strings are clamped in parallel) in order to cause them to vibrate. To this end, the piano hammer is integrated into a complicated mechanism that, in addition to the hammer striking the string, also serves other elements, for example sound attenuation. The piano hammer per se comprises a hammer handle and a hammer head, with the latter actually impacting the string to be struck or, respectively, the strings to be struck, upon actuation. The core of the hammer head of a piano hammer, like the hammer handle, is frequently made of wood but is not necessarily limited to this material. In this context, the core of the hammer head is provided with a cover with which the hammer head will impact the strings to be struck when the corresponding key of the keyboard is activated. Nowadays, felt is usually used as material for the cover, but leather has also been used before. Other materials with comparable properties are conceivable for use as cover as well.

In the case of known pianos, the hammer or, respectively, the hammer cover is typically designed in the shape of a drop with a strike area with which it impacts the string or, respectively, the strings when the corresponding key is activated. In this context, for example in the case of the use of felt for the cover of the hammer head, as is quite common today, the density or, respectively, the compression of the felt plays an essential role with regard to the sound properties or, respectively, the intonation of the instrument when the hammer is activated. For example, during the manufacture of pianos at the factory, the felt covers of the hammers are loosened in the areas with which they impact the string or, respectively, the strings for an acoustic tuning by piercing their surface with certain tools, thereby conditioning the felt. This work must be performed by experienced tuning personnel and is time consuming. In particular, it will be hardly possible to recompress a piano hammer treated by the process described above whose cover, in particular a felt cover, has been loosened too much by means of the aforementioned piercing. In the worst case, the hammerhead, or even the entire hammer, will have to be replaced while still in the production process and the tuning must be performed anew.

SUMMARY OF THE INVENTION

It is here that the invention is intended to provide a remedy by providing a piano hammer that in particular makes a considerably easier and reproducible tuning possible that, in particular, is also intended to be reversible.

The idea of the invention which, in retrospect, at first looks amazingly simple but which represents a nearly revolutionary novelty in the area of the manufacture of musical instruments, more precisely in piano production, consists of equipping the hammer head right from the start with a cover of varying density along a circumferential surface with which it can impact the strings to be struck. Another essential aspect in this respect is the fact that the hammer head that in the case of current piano hammers is rigidly fastened to the hammer handle is adjustable with regard to the position of its circumferential surface with which it impacts the string or, respectively, the strings to be struck.

Due to these two measures, it is possible to provide a piano hammer from the start with defined (and to that extent, reproducible and reversibly adjustable) varying densities of its cover and to perform an adjustment during the tuning or, respectively, sound adjustment of the piano by adjusting the position of the circumferential surface of the hammer with which it strikes the string(s). In other words, an instrument maker or, respectively, tuner can perform the adjustment of the sound coloration of the piano by simply repositioning the hammer head relative to the hammer handle without having to loosen the felt cover with a piercing awl or comparable instrument and, in the event of a "too much" of this loosening, not having an opportunity for a correction other than replacing the hammer head or the hammer entirely.

A sound adjustment of the instrument will thereby be achievable not only considerably more quickly, adjustment errors, in particular, can be corrected or the sound adjustment can be changed or readjusted again even at a later point in time.

A simple method to produce the covers of varying density according the invention consists of using a felt cover that is compressed at varying densities along the circumferential surface. If, for example, an essentially cylinder-shaped hammer head is used, a felt strip may be glued to the circumferential surface that was obtained by compressing a felt material having a starting material thickness that increases in wedge-shaped fashion to a uniform final material thickness. This results in this case in a continually changing degree of material density so that a multitude of adjustment options opens up without any gradation.

A simple option for designing the piano hammer according to the invention consists in designing the hammer head as a rolling body, in particular having a cylindrical shape, and clamped into the hammer handle with a rotational axis around which it is rotatable and fixable in a desired rotational position relative to the hammer handle. The fixation of the rotational position can be done, for example, through jamming or, respectively, installing a holding screw on the rotational axis itself, or in any other suitable manner. In this context, the rolling body can be rotated around the rotational axis without changing the distance of the hammerhead from the site of impact on the string or strings to be struck, thereby leading to a different type of mechanics with regard to the key activation. A dislocation of the hammerhead designed in that way may occur in both directions, i.e. forward and back, so that corrections can be made during the tuning of the instrument until the desired intonation has been achieved.

To ensure that the hammer head will strike uniformly even several strings needing to be struck parallely in the piano to produce one single tone, it will be advantageous if the varying density of the cover is present only in one plane vertically to the rotational axis while a constant density prevails in the direction of the rotational axis.

In a further development it may be provided for the piano hammer to be motor driven so that the position of the circumferential surface with which the hammerhead impacts the string or, respectively, strings to be struck can be adjusted. On the one hand, during the tuning to be done at the end of the manufacturing process of the piano at the factory, such a motor drive can facilitate the work on the whole and shorten the required period of time. However, this does not represent the main advantage. Instead, on the other hand, with such a drive the tuning of the piano can be altered or, respectively, adjusted at a later time by adjusting the position of the circumferential surface of a hammer or of several hammers and thereby the density of the cover with which the string or, respectively, strings are struck. In this way, in particular, it will also be possible, for various uses of the piano, for example for the playing of music of different styles or composers, to provide the piano in each case with a different intonation. In this case, for example, in collaboration with a control device built into the piano, a preset intonation can be activated by moving, via the controls, the circumferential surfaces of the hammers into their respective positions from with which they will then strike the individual strings. This will increase the variability of a piano considerably; one and the same instrument can be played in completely different intonations, something for which nowadays two or even more instruments must be kept on hand in concert halls or the like.

Finally, one object of the invention is also a piano per se that is equipped with at least one piano hammer with the characteristics described above.

BRIEF DESCRIPTION OF THE DRAWINGS

The present invention is further illustrated by the following examples and figures, without being restricted thereto.

DETAILED DESCRIPTION OF THE INVENTION

The figures show an embodiment of the invention in schematic representations that merely serve illustration purposes, with a description to follow. In this context, FIG. 1 shows a piano hammer according to the state of the art; the designs of the invention are sketched in FIGS. 2-4.

Figure 1:
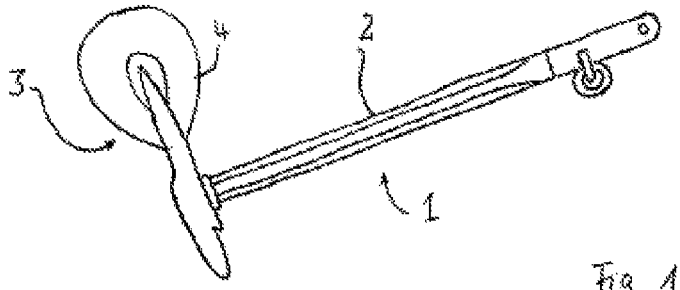
FIG. 1, a schematic representation of a piano hammer in the conventional design of the state of the art.

In FIG. 1, a conventional piano hammer is shown for comparison purposes, in this case, a piano hammer 1 for installation in a grand piano. The piano hammer 1 is shown here in its installed position since in the grand piano it strikes the strings from below. For a strike, the piano hammer 1 shown here shoots upward with its hammer head 3 arranged at the end of the hammer handle 2 and impacts there with its cover 4 of the hammer head 3 the piano string to be struck. In this case, the hammer head 3, more precisely the cover 4 located on it and typically made of felt, will always impact the string to be struck with one and the same section of its surface.

In the state of the art, during the final tuning of the grand piano, such a piano hammer 1 will be loosened by a piano tuner in the area of the cover 4 with which the hammerhead 3 impacts the string by piercing the felt until the intonation of the grand piano is correct when the tone is struck. In the case of the piano hammer 1 according to the state of the art, the hammerhead 3 or, respectively, the cover 4 are firmly fixed in place relative to the hammer handle 2 and can not be moved. To that extent, the surface of the cover 4 with which it impacts the string of the grand piano can not be changed in its position.

Figure 2:
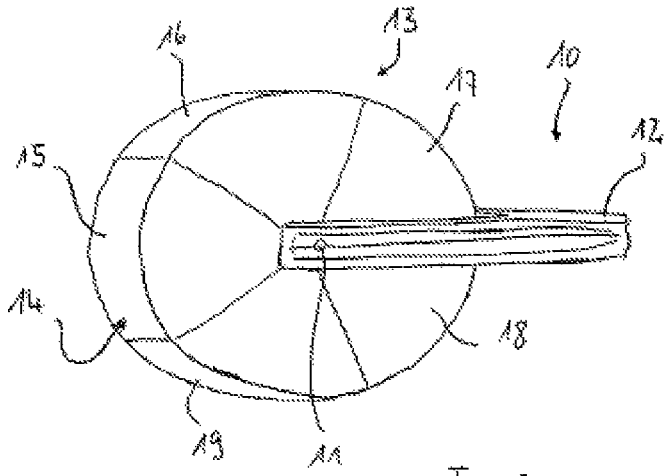
FIG. 2, in a cutout, the hammer head with its suspension from the hammer handle of a piano hammer in an embodiment of the invention.

This is designed differently in the case of a hammer 10 according to the invention which is shown schematically in FIG. 2. Here, the hammer head 13 with a cover 14 is located on the hammer handle. Here, the hammer head 13 is designed in the shape of a cylinder, with the cover, which in this case is also made of felt, surrounding the surface of the cylinder. The hammerhead 13 is mounted in rotatable fashion around a rotational axis 11 in the hammer handle 12 which encloses the hammer head in fork-like fashion. The various areas or, respectively, zones 15 through 19 in which the cover 14 has different thicknesses and that are drawn schematically are easy to see.

According to the invention, the hammer head 13 equipped with varying densities along its circumferential surface can be rotated around the rotational axis 11 so that the position of its surface (and thus also the respective areas 15, 16, 17, 18 or, respectively, 19 with their corresponding varying densities) with which the hammer head 13 impacts the string to be struck can be adjusted by simply turning the hammer head 13 around its rotational axis 11. After the adjustment has been completed, the hammer head 13 can be positioned and fixed relative to the hammer handle 12, for example by blocking the rotational axis 11 by suitable means.

It should be apparent that with the use of such a piano hammer 10 according to the invention, the adjustment of the desired intonation of the instrument will be considerably easier and more reproducible than through mechanical loosening of the felt cover 4 in the case of the piano hammer 1 according to the state of the art.

Figure 3:
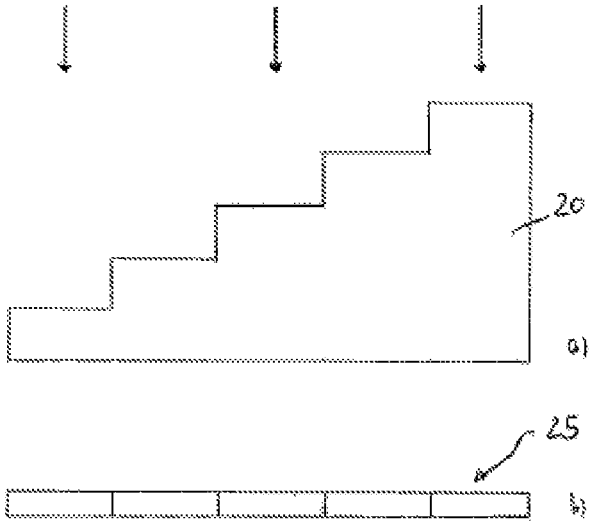
FIG. 3, in two representations a) and b), one option for obtaining a cover for a hammer head of a piano hammer that has zones of varying thicknesses.
Figure 4:
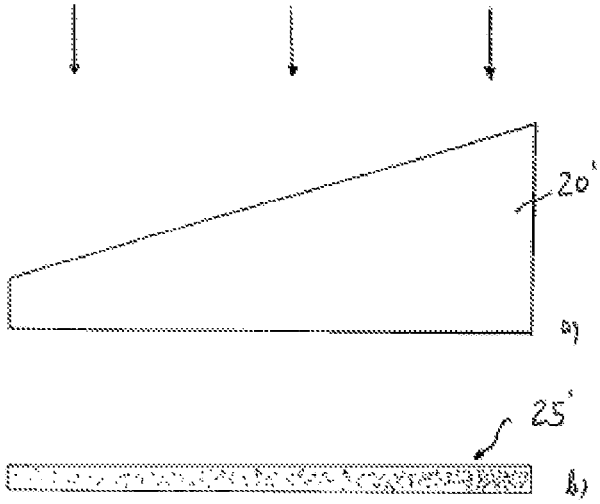
FIG. 4, in a representation comparable with FIG. 3, an additional option for obtaining a cover for a hammer head that has different thicknesses in different sections.

FIG. 2 shows schematically a hammer head having in its cover 14, in terms of zones, a total of five areas of varying density (areas 15 through 19). Such a cover 14, which in particular may be a felt cover, may be produced, for example, from felt by means of compression, as shown in FIG. 3*a* and marked as 20. In this case, a felt of constant density and varying height (step-like structure) is selected that is compressed in the direction indicated by the arrows in FIG. 3*a* and pressed into shape. This will result in a felt cover of uniform height as shown in FIG. 3*b* but having five areas of varying density (from left to right with increasing density). Alternatively, in order obtain an even finer adjustment option, a felt as shown in FIG. 4*a* and marked as 20' may be compressed. That will yield a cover 25' that has a continually increasing density from left to right in FIG. 4*b* and that, to that extent, will afford a finer tuning of the intonation of the instrument. With regard to FIGS. 3 and 4 it is important to mention that the finished felt covers 25 through 25' are of uniform thickness in the direction vertical to the plane of projection, that the densities change only in the plane of projection seen from left to right, in the case of cover 25 of FIG. 3*b*, step by step in five areas, in the case of felt cover 25' in FIG. 4*b* continuously and without any leaps.

Finally, it is within the framework of the invention to equip a piano hammer 12, such as in FIG. 2, with a drive (not shown there) that twists the hammer head 13 in motorically driven fashion around the rotational axis 11 and fixes it in any position it reaches, for example by means of a self-locking device. In addition to the mere opportunity to set a desired position one single time in motor-driven fashion, thereby being able to work faster and more efficiently, there results in this case in particular a further degree of freedom of adjusting the intonation of the instrument depending on the utilization situation. Such a motoric drive that is easy to realize by means of micro motors and the corresponding wiring guided through the hammer handle 12 (power supply and control signals) will then be able to interact with a control device located in the instrument in order to, for example, retrieve preset intonations and to adjust them correspondingly by means of rotation of the hammerhead 13.

While the invention has been described with reference to exemplary structures and methods in embodiments, the invention is not intended to be limited thereto, but to extend to modifications and improvements within the scope of equivalence of such claims to the invention.

LIST OF REFERENCE SYMBOLS

1 piano hammer
2 hammer handle
3 hammer head
4 cover
10 piano hammer
11 rotational axis
12 hammer handle
13 hammer head
14 cover
15 area
16 area
17 area
18 area
19 area
20 felt
20' felt
25 cover
25' cover

The invention claimed is:

1. A piano hammer for striking strings of a piano, comprising a hammer handle and a hammer head covered at least along part of its surface with a cover, wherein the cover is of varying density along its perimeter surface and the hammer head is adjustable with regard to the position of its perimeter surface with which the cover impacts one or more strings to be struck.

2. The piano hammer according to claim 1, wherein the perimeter surface is a circumferential surface.

3. The piano hammer according to claim 2, wherein the cover comprises compressed felt having two or more different density zones along the circumferential surface.

4. The piano hammer according to claim 2, wherein the cover includes a continually increasing circumferential surface density from a first density point on the surface cover around to a second higher density point on the surface of the cover.

5. The piano hammer according to claim 1, wherein the hammer head includes a rotational axis clamped into the hammer handle around which the cover is rotatable and fixable in a desired rotational position relative to the hammer handle.

6. The piano hammer according to claim 5, wherein the cover includes two or more zones with different densities around the perimeter of the cover that has a generally uniform thickness.

7. The piano hammer according to claim 5, wherein the cover includes adjoining density regions having different densities in a circumferential direction and each density region extends through the cover in a direction toward the rotational axis.

8. The piano hammer according to claim 1, wherein the cover comprises two or more different density zones along the perimeter surface.

9. The piano hammer according to claim 8, wherein the cover comprises compressed felt.

10. The piano hammer according to claim 8, further comprising a central axis of rotation and wherein the gradient of density in a density zone along a plane including the axis of rotation and an axis in the density zone parallel to the axis of rotation is approximately zero.

11. The piano hammer according to claim 1, further comprising a motoric drive to adjust the position of the perimeter surface of the cover with which it impacts one or more strings.

12. A piano having at least one piano hammer according to claim 1.

13. A method of adjusting the sound of a piano comprising repositioning a cover coupled to a piano hammer from a first string contacting surface on the perimeter of the cover to a different second contacting surface of the perimeter having different density from the first contacting surface.

14. The method according to claim 13, wherein the repositioning includes rotating the cover.

15. The method according to claim 14, wherein the perimeter is a circumferential surface.

16. The method according to claim 15, wherein the first contacting surface is of a first density zone and the second contacting surface is of a second density zone.

17. The method according to claim 14, wherein the first contacting surface is of a first density zone and the second contacting surface is of a second density zone.

18. The method according to claim 13, wherein the first contacting surface is of a first density zone and the second contacting surface is of a second density zone.

* * * * *